US005649586A

United States Patent [19]

Kazama et al.

[11] Patent Number: 5,649,586

[45] Date of Patent: Jul. 22, 1997

[54] INJECTION MOLDING APPARATUS

[75] Inventors: Shinji Kazama; Atsushi Suzuki; Nobumasa Hamazoe; Kazuya Sakamoto; Masayoshi Kai; Hiromitsu Suganuma; Hiroshi Mizutani, all of Sayama, Japan

[73] Assignee: Honda Giken Kogyo Kabushiki Kaisha, Japan

[21] Appl. No.: 620,140

[22] Filed: Mar. 21, 1996

[30] Foreign Application Priority Data

Mar. 22, 1995 [JP] Japan ..... 7-063179
Mar. 22, 1995 [JP] Japan ..... 7-063192

[51] Int. Cl.[6] ..... B22D 17/10

[52] U.S. Cl. ..... 164/155.4; 164/154.1; 164/312; 164/900

[58] Field of Search ..... 164/457, 4.1, 900, 164/71.1, 154.1, 154.2, 155.1, 155.4, 312, 113

[56] References Cited

U.S. PATENT DOCUMENTS 4,959,001 9/1990 Langiouis et al. ..... 425/147

FOREIGN PATENT DOCUMENTS 5-285625 11/1993 Japan .

*Primary Examiner*—Kuang Y. Lin
*Attorney, Agent, or Firm*—Merchant, Gould, Smith, Edell, Welter & Schmidt

[57] ABSTRACT

A receiving chamber receives a material heated in a heating chamber. An injecting shaft of an injecting machine slurries the material crushed by cutters downstream of the receiving chamber and feeds the slurried material to an injection port formed between the fore ends of the shaft and injecting chamber so that the slurried material is gradually accumulated in the port. The shaft is retracted by counteraction from the slurried material accumulated in the port, over a distance proportional to a current accumulated amount of the material in the port. The current accumulated amount of the material in the port can be detected from a current position of the shaft, and then it is determined whether the detected current accumulated amount has reached a predetermined amount. When the current accumulated amount has not reached the predetermined amount, the cutters and injecting shaft are further driven until the predetermined amount is reached. The receiving chamber has a pair of passage sections on its outer surface in opposed relation to each other, which function both as light beam passages for light emitting and receiving elements that are provided on the sections for detecting whether a heated material is in the receiving chamber, and as inert gas supply passages to direct inert gas into the receiving chamber.

5 Claims, 8 Drawing Sheets

INJECTION MOLDING APPARATUS

BACKGROUND OF THE INVENTION

1. Field of the Invention

The present invention relates generally to injection molding apparatuses for heating and slurrying an ingot or metal material, and each time a predetermined amount of the slurried material is accumulated in an injection port of an injecting machine, injecting the slurried material into a mold to form a desired metal molded article.

More particularly, the present invention relates to an improved injection molding apparatus which constantly permits forming of good-quality molded articles by performing control such that an uniform amount of the slurried material can always be injected into the mold.

The present invention also relates to an improved injection molding apparatus which can greatly simplify the arrangements required for detecting whether or not there is an ingot in a heated-ingot receiving chamber provided upstream of ingot crushers and for supplying inert gas into the receiving chamber, and which also permits reliable detection of presence or absence of an ingot in the receiving chamber as well as reliable and smooth supply of inert gas into the receiving chamber.

2. Description of the Related Art

In Japanese Patent Laid-Open Publication No. HEI 5-285625, the assignee of the present invention proposes an injection molding apparatus for manufacturing metal molded articles, which is designed to increase productivity by heating and slurring an ingot, i.e., material to be molded, in successive operations as will be outlined below with reference to FIG. 9.

FIG. 9 is a vertical sectional view schematically showing the proposed injection molding apparatus 100, which generally comprises a screw-type injecting machine 101 including a screw shaft 111 rotatable and axially movable within a machine cylinder and having a spiral groove along a predetermined length thereof, and a material feeder section 102. The material feeder section 102 includes, in the top-to-bottom direction of the figure, an ingot entry 103, ingot heating chamber 104 provided with an inductive heater, and crushed material accumulating chamber 107 having rotary cutters 106. The accumulating chamber 107 is connected in communication with the heating chamber 104 via a heated-ingot receiving chamber 105. The interior of the entire material feeder section 102 is maintained in a vacuum or inert gas atmosphere, and the above-mentioned chambers 103, 104 and 105 are partitioned off by sliding shutters 108 and 109.

In the proposed injection molding apparatus 100, an ingot 110, such as an Mg alloy ingot, fed via the ingot entry 103 is heated in the heating chamber 104 into a half-molten condition and passed through the chamber 105 to the crushing/accumulating chamber 107 to be crushed by the rotary cutters 106. Then, the crushed material is fed to the injecting machine 101, where it is agitated and kneaded into slurry by rotation of the screw shaft 111 and temporarily accumulated, as a final slurried material to be molded, in an injection port formed between the fore ends of the machine cylinder and screw shaft 111. Each time the slurried material has been accumulated to a predetermined amount necessary for forming a desired metal molded article, it is directly or indirectly injected through a nozzle into a cavity 113 of a metal mold 112 by injecting action of the screw shaft 111.

However, the material tends to be crushed into non-uniform sizes and thus the crushed material tends to be fed from the cutters 106 to the injecting machine 101 in non-uniform amounts, particularly because the crushing and feeding rate of the crushed material depends on the operating rate of the cutters 106 being intermittently driven. Consequently, the slurried material would often be injected, in an amount short of the predetermined amount, from the injection port of the machine 101 into the mold 112, with the result that proper molded articles could often not be formed. If the cutters 106 are constantly driven in order to avoid the above-mentioned problem, the crushed material may be overfed to the injecting machine 101 and excessively accumulated up to the cutters located upstream of the injecting machine 101. As a result, the excessively accumulated crushed pieces will thrust in between the cutters 106, thus seriously damaging the cutters 106.

Further, in the molding apparatus 100, if the heated ingot 110 is not properly fed from the receiving chamber 105 to the cutters 106, the cutters 106 may run idle resulting in no crushed material being supplied to the injecting machine 101. Such an idle condition is undesirable from the viewpoint of efficiency of the injection molding apparatus. Therefore, when supply of the heated ingot 110 to the cutters 106 is interrupted for some reason, a next ingot must be immediately supplied via the receiving chamber 105 to the cutters 106. Besides, the ingot must be fed to the cutters 106 smoothly and reliably. To this end, it is necessary to reliably detect whether there is a heated ingot received in the receiving chamber 105 so that a next ingot can be immediately fed to the receiving chamber when no ingot is received therein.

Further, in order to prevent unwanted oxidation of the ingot, the receiving chamber 105, etc. must be maintained in an inert gas atmosphere. Besides, the receiving chamber 105 has a limited height just sufficient to vertically receive the heated ingot to be crushed by the cutters 106. But, in the prior art molding apparatus 100, the arrangements for detecting presence or absence of an ingot in the heated-ingot receiving chamber 105 and supplying inert gas into the receiving chamber 105 are provided completely separately in the chamber 105, and they require a large space and too many parts. Further, because such parts are attached directly to the wall surface of the receiving chamber, a number of steps are required to make the receiving chamber itself.

SUMMARY OF THE INVENTION

It is therefore an object of the present invention to provide an injection molding apparatus, for manufacturing a metal molded article, which constantly permits forming of good-quality molded articles by performing control such that an uniform amount of the slurried material can always be injected from an injecting machine into the mold.

It is another object of the present invention to provide an injection molding apparatus which can greatly simplify the arrangements required for detecting whether or not there is an ingot in a heated-ingot receiving chamber provided upstream of ingot crushers and for supplying inert gas into the receiving chamber, and which also permits reliable detection of presence or absence of an ingot in the receiving chamber as well as reliable and smooth supply of inert gas into the receiving chamber.

In an injection molding apparatus, for manufacturing a metal molded article, according to a first aspect of the present invention, a heating chamber heats a material to be molded into a half-molten condition, and a crusher (e.g., rotary cutters) crushes the material heated in the heating chamber. An injecting machine includes an injecting chamber or cylinder for receiving the ingot crushed by the crusher, and an injecting shaft (e.g., screw shaft) rotatably provided within the injecting chamber and axially movable along the injecting chamber toward and away from a mold. The injecting shaft slurries the crushed material and feeds the resultant slurried material to an injection port formed between the fore ends of the shaft and injecting chamber adjacent the mold so that the slurried material is gradually accumulated in the injection port. The injecting shaft is slightly retracted away from the mold, by counteraction from the slurried material accumulated in the port, over a distance proportional to a current accumulated amount of the slurried material in the port. Only when the slurried material is accumulated in the injection port to a predetermined amount necessary for forming a desired metal molded article, the injecting shaft is driven to move toward the mold to inject that predetermined amount of the slurried material from the port into the mold.

A determination section detects a current position of the injecting shaft which is designed to be retracted by the counteraction from the slurried material accumulated in the injection port, to thereby detect a current accumulated amount of the slurried material in the port. The determination section then determines whether the detected current accumulated amount of the slurried material has reached the predetermined amount. When the determination section determines that the detected current accumulated amount has not reached the predetermined amount, a control section further drives the crusher and injecting shaft until an amount of the slurried material short of the predetermined amount is additionally supplied to the port, i.e., until the predetermined amount is reached in the port.

The above-mentioned injection molding apparatus according to the first aspect is based on the inventors' finding that a current position of the injecting shaft designed to be retracted by the counteraction from the slurried material accumulated in the injection port corresponds to a current accumulated amount of the slurried material in the injection port, and therefore the current accumulated amount of the slurried material can be detected by detecting the current position of the shaft. When the detected current accumulated amount has not reached the predetermined amount, the control section further drives the crusher and injecting shaft for a period until the predetermined amount is reached in the port. With such control, an uniform amount of the slurried material can always be injected from the injecting machine into the mold and thereby it is possible to constantly form good-quality molded articles.

In an injection molding apparatus, for manufacturing a metal molded article, according to a second aspect of the present invention, a pair of passage sections are provided at predetermined positions on the outer surface of the receiving chamber in opposed relation to each other. The passage sections have internal hollow spaces which communicate with the interior of the receiving chamber generally in the same plane transverse of the interior of the receiving chamber. A photo sensor is provided for detecting whether there is any heated material in the receiving chamber, and it includes a light emitting element mounted on one of the passage sections and and a light receiving element mounted on the other passage section so that a light beam emitted by the emitting element on the one passage section is allowed to pass through the interior of the receiving chamber and to the receiving element on the other passage section along said hollow spaces when there is no heated material in the receiving chamber. An inert gas supply section includes pipes connected to the passage sections for introducing inert gas into the receiving chamber via the internal hollow spaces of the passage sections. Thus, the passage sections function as passages for both the light beam and inert gas.

In the molding apparatus according to the second aspect, the passage sections are designed to function as light beam passages for the photo sensor for detecting whether there is any heated material in the receiving chamber, and also as passages for supplying inert gas into the receiving chamber. Namely, the passage sections can be used in common for optically detecting an heated material in the receiving chamber and supplying inert gas into the receiving chamber, and this can greatly simplify the arrangements required for the optical detection of presence or absence of the heated material in the receiving chamber and inert gas supply to the receiving chamber.

The light emitting and receiving elements are preferably mounted at positions corresponding to the lower end of the material received in the receiving chamber. The hollow space of each of the passage sections may be covered at the outer end thereof with a transparent glass plate and the light emitting and receiving elements may be disposed outwardly of the glass plates. Each of the passage sections preferably has an inert gas entry port opening toward the glass plate so that the inert gas supplied by the gas supply section is blown via the entry port onto the glass plate. This inert gas blowing cleans the glass plates, so that the optical detection by the light emitting and receiving elements can be performed reliably. Further, each of the light emitting and receiving elements is preferably mounted on a stay secured to the corresponding passage section, and in such a case, it is preferable that each of the passage sections include a water-cooling jacket connected to the stay for preventing heat of the receiving chamber from being conducted via the stay to the light emitting or receiving element.

BRIEF DESCRIPTION OF THE ACCOMPANYING DRAWINGS

The above and other objects, advantages and features of the present invention will become apparent from the following detailed description of the preferred embodiments when read in conjunction with the accompanying drawings, in which.

DETAILED DESCRIPTION OF THE PREFERRED EMBODIMENTS

Figure 1:
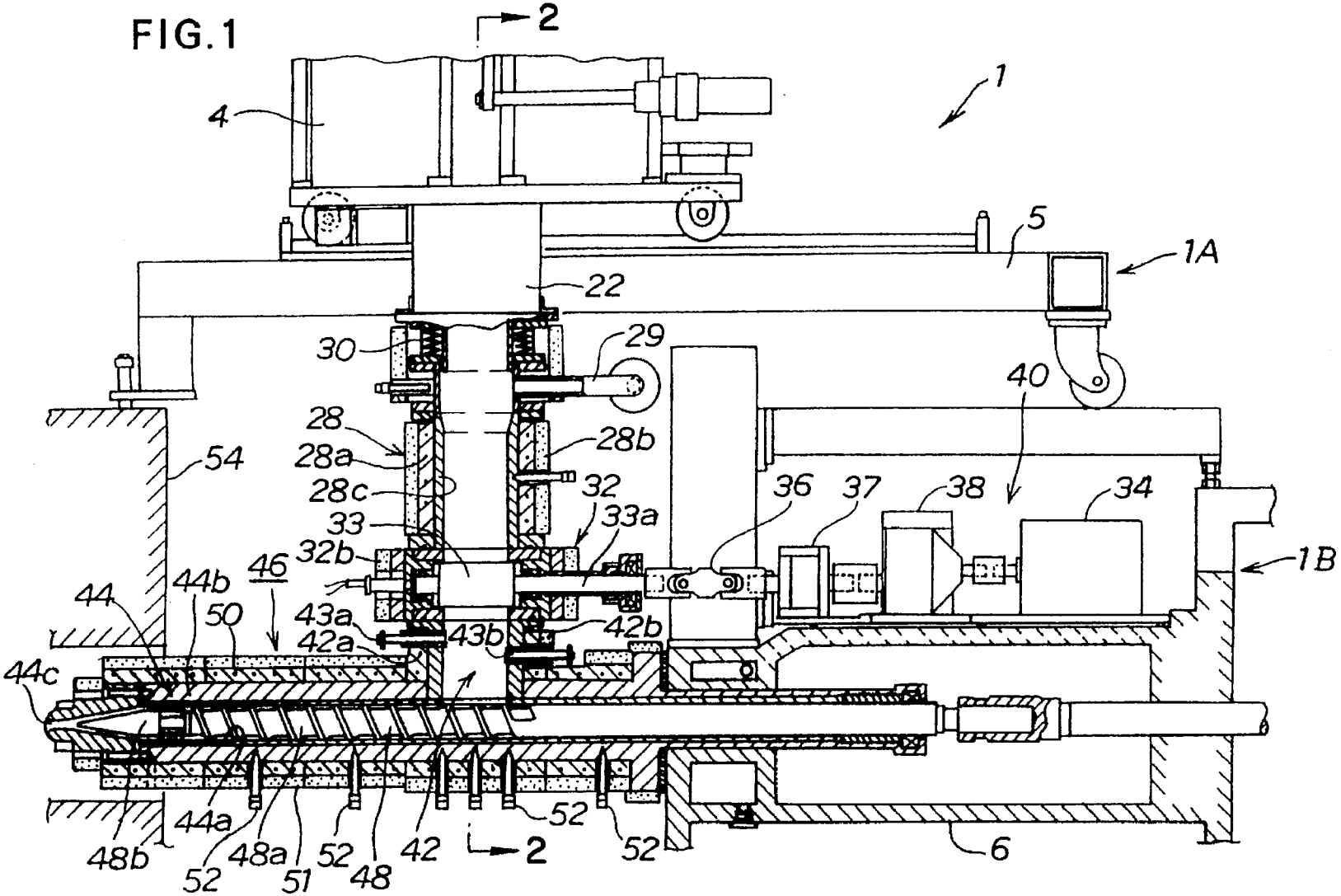
FIG. 1 is a partly-sectional side view showing the principal part of an injection molding apparatus, for manufacturing a metal molded article, according to an embodiment of the present invention.
Figure 2:
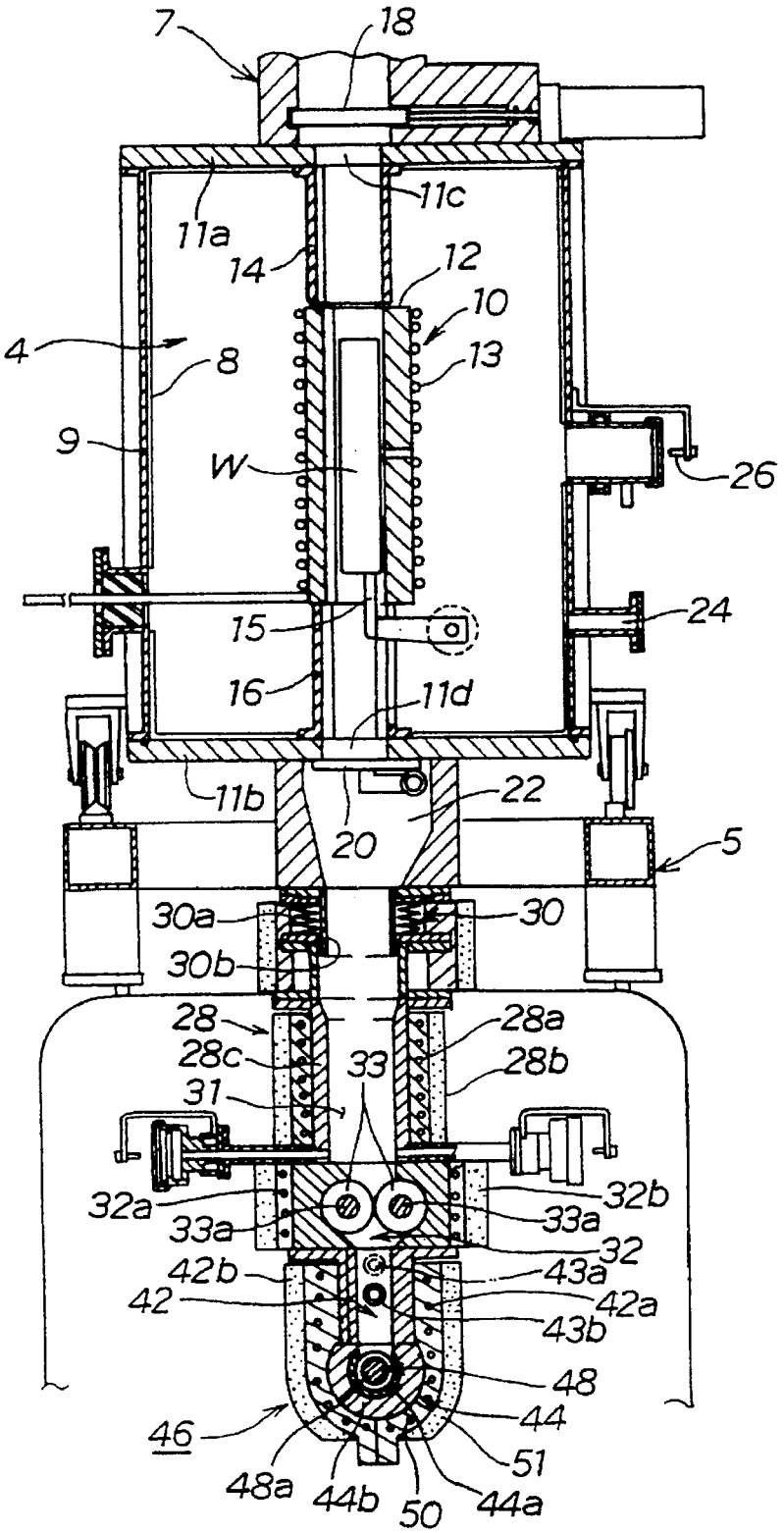
FIG. 2 is a sectional view along line A—A of FIG. 1.

FIG. 1 is a side view, partly in section, showing the principal part of an injection molding apparatus 1 according to an embodiment of the present invention, and FIG. 2 is a sectional view along line A—A of FIG. 1.

As shown in FIG. 1 and particularly in FIG. 2, the injection molding apparatus 1 includes an ingot heating chamber 4 is supported on a support 5 mounted on a support base 6 and is disposed below or downstream of an ingot entry 7 where an ingot W, such as a Mg alloy ingot, is received. The heating chamber 4 includes a vacuum-heating vessel comprised of a magnetic-shielding inner wall 8 and a cylindrical outer wall 9, and an inductive heater unit 10 enclosed within the vessel. The vacuum-heating vessel is closed at its upper and lower ends by top and bottom cover plates 11*a* and 11*b*, respectively. The inductive heater unit 10 is comprised of a vertical inner holder 12 formed of a ceramic material and inductive heating coil 13 wound around the outer periphery of the ceramic holder 12.

As seen in FIG. 2, the ceramic holder 12 is supported at its upper and lower ends by vertical guide cylinders 14 and 16, respectively, and thus the holder 12 is retained vertically centrally within the vacuum-heating vessel. Upper horizontal shutter 18 is provided in the ingot entry 7, immediately above an ingot entry hole 11*c* formed in the top cover plate 11*a* of the heating chamber 4, for sliding movement along the plate 11*a* to open or close the hole 11*c*, i.e., to place the heating chamber 4 into or out of communication with the ingot entry 7. When the shutter 18 is in the fully-opened or fully-retracted position, the heating chamber 4 is placed in full communication with the ingot entry 7 so that the ingot W can be fed from the entry 7 to the heater unit 10. The ingot W is temporarily held, for heating into a half-molten state, in the holder 12 of the heater unit 10, with its underside supported by a vertically pivotable stopper 15.

Lower horizontal shutter 20 is provided, immediately below an ingot exit hole 11*d* formed in the bottom cover plate 11*b* of the heating chamber 4, for pivotal movement to open or close the exit hole 11*d*, i.e., to place the heating chamber 4 into or out of communication with a downstream ingot guiding chamber 22. Reference numeral 24 denotes a nozzle for evacuating air from the interior of the heating chamber 4 to place it in a vacuum condition or drawing inert gas into the chamber 4, and provided above the nozzle 24 is a radiation thermometer 26 for monitoring the temperature of the ingot W in the heating chamber 4.

By pivoting the stopper 15 in the counterclockwise direction of FIG. 2 to release the ingot W and moving the lower shutter 20 to the fully-opened position, the ingot W is transferred downward through the guiding chamber 22 and flexible connector unit 30 into a heated-ingot receiving chamber 28, via which it is sent to a crushing chamber 32 for crushing by rotary cutters 33.

The ingot guiding chamber 22 communicates with the heated-ingot receiving chamber 28, via the flexible connector unit 30 that preferably comprises bellows 30*a* capable of expanding and contracting in the vertical direction. The heated-ingot receiving chamber 28 includes an inner metallic cylinder 28*c*, heater 28*a* disposed around the outer periphery of the metallic cylinder 28*c*, and an outer thermal insulating material 28*b* enclosing the cylinder 28*c* and heater 28*a*. The receiving chamber 28 has a limited height just sufficient for receiving the heated ingot W in the vertical position, and also includes a lower space 31 communicating with the upper end interior of the downstream crushing chamber 32. The heated ingot W is received in the receiving chamber 28 with its lower end W1 inserted or nipped between the opposed cutters 33 disposed in the downstream crushing chamber 32 (see FIG. 6).

Pipe 29 is provided on the upper end portion of the receiving chamber 28 for evacuating air from the interior of the chamber 28 to place it in a vacuum condition or drawing inert gas into the chamber 28 to place the chamber 28 in an inert gas atmosphere. By the heater 28*a*, the chamber 28 is maintained at a temperature to retain the high temperature of the heated ingot W. Thus, the chamber 28 functions as a heat-retaining chamber.

Figure 3:
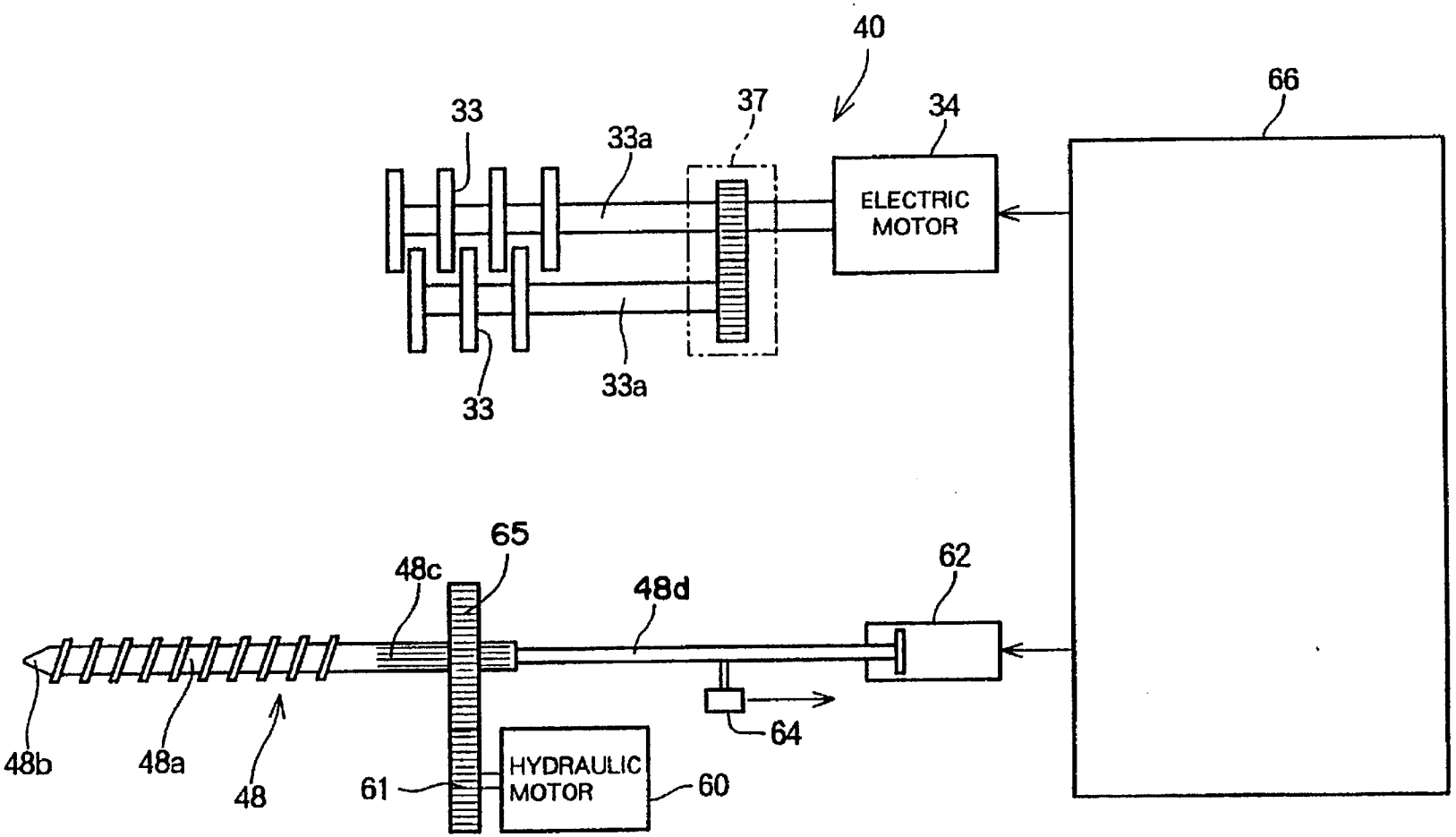
FIG. 3 is a view showing cutters and screw shaft of FIG. 1 and respective drive mechanisms for the cutters and screw shaft.

As seen in FIGS. 1 and 3, the crushing chamber 32 contains, as crusher means, a pair of rotary cutters 33 having respective drive shafts 33*a* which are operatively connected to a single electric motor 34 via a universal joint 36, a dual-axis gear case 37 having one input axis and two output axes and a speed reducer 38. The drive shafts 33*a*, universal joint 36, gear case 37, speed reducer 38 and motor 34 together constitute a common drive unit 40 for the cutters 33, and this drive unit 40 is supported on the support base 6. The opposed cutters 33 are thus driver; by the drive unit 40 to sequentially cut the ingot W from the lower end thereof. The heated-ingot receiving chamber 28 and crushing chamber 32 are normally maintained in an inert gas atmosphere in order to prevent oxidation of the ingot W.

The ingot W crushed by the rotary cutters 33 (i.e., crushed material) is then sent to a crushed material accumulating chamber 42, where upper and lower level sensors 43*a* and 43*b* are provided to detect a current level of the crushed material accumulated in the chamber 42. The crushed material accumulating chamber 42 is in communication with a cylinder section 44 of an injecting machine 46 via an opening 44*a* formed in the axially middle portion of the cylinder 44 so that the crushed material is fed through the opening 44*a* to the injecting machine 46.

Similarly to the heated-ingot receiving chamber 28, the above-mentioned crushing and accumulating chambers 32, 42 are enclosed by heaters 32*a*, 42*a* and thermal insulating materials 32*b*, 42*b*, respectively, so that the ingots W are crushed and accumulated while being maintained at a predetermined high temperature. These chambers 28, 32, 42 together constitute a continuous material feeding chamber for the injecting machine 46, which is kept warm to retain the high temperature of the material to be fed to the injecting machine 46.

As further shown in FIG. 1, the injecting machine 46 includes the cylinder section or injecting chamber 44, and an injecting shaft 48 which in this embodiment is a screw-type shaft 48. The cylinder section 44 forming the injecting chamber is a dual structure composed of a horizontal inner cylinder 44*a*receiving the above-mentioned screw shaft 48 and an horizontal outer cylinder 44*b*. The outer cylinder 44*b* is surrounded by a heater 50 for heat-retaining (or further heating if necessary) the cylinder section 44, and the heater 50 is enclosed by a heat insulating material 51. The cylinder section 44 is supported at its rear end portion by the support base 6. A plurality of sensors 52 are provided for monitoring a current temperature of the cylinder section or injecting chamber 44 so as to precisely control the heat-retaining or heating operation of the heater 50 as necessary. The screw shaft 48 is movable back and forth in the axial direction within the cylinder section 44 and has a spiral groove 48*a* formed along a predetermined length thereof.

In the injection molding apparatus 1, feeding of the crushed material into the accumulating chamber 42 and cylinder section 44 is effected through the crushing operation of the rotary cutters 33; that is, while the cutters 33 are driven by the drive unit 40, the crushed material is introduced into the cylinder section 44 by way of the accumulating chamber 42. In other words, the crushing and feeding rate of the crushed material depends on the operating rate of the cutters 33 being intermittently driven. The thus-introduced crushed material is agitated and kneaded into slurry by the rotating screw shaft 48 having the spiral groove 48*a*, and the thus-slurried material is moved, by the feeding action of the groove 48*a*, forward to an injection port 44*c* formed between the fore end 48*b* of the shaft 48 and the inner fore end portion of the cylinder section 44.

The ingot entry 7, heating chamber 4 and ingot guiding chamber 22 together constitute an upper unit 1A of the apparatus 1, while the heated-ingot receiving chamber 28, crushing chamber 32, crushed material accumulating chamber 42, injecting machine 46, support base 6 etc. together constitute a lower unit 1B of the apparatus 1. The upper unit 1A is normally fixedly supported on the support 5 mounted on the support base 6.

The upper and lower units 1A and 1B are interconnected via the flexible connector unit 30, in a sealed condition, so that the ingot W is transferred from the upper unit 1A to the lower unit 1B through the connector unit 30 and in such a manner to allow the lower unit 1B to vertically displace toward the upper unit 1A. Cylindrical ingot guide 30*b* is disposed within the bellows 30*a*, and has a length or height to extend virtually along the full vertical length of the expanded bellows 30*a*. The upper ends of the bellows 30*a* and ingot guide 30*b* are together fastened to the lower end of the ingot guiding chamber 22, but the lower end of the bellows 30*a* alone is fastened to the upper end of the heated-ingot receiving chamber 28 with the lower end of the ingot guide 30*b* being left unfastened, so as to permit free vertical expansion and contraction of the bellows 30*a*. This arrangement permits the lower unit 1B to displace vertically with respect to the upper unit 1A, so that thermal expansion and mechanical shocks and vibrations caused in the lower unit 1B can be effectively absorbed by the flexible connector unit 30.

FIG. 3 shows the respective drive units for the cutters 33 and screw shaft 44, and as shown, the screw shaft 48 has a rear spline shaft portion 48*c* and is rotated by a drive means 60 such as a hydraulic motor, via a drive gear 61 and a driven gear 62 meshing with the gear 61 and fixedly mounted on the spline shaft portion 48*c*. The drive means 60, drive gear 61, driven gear 65 and spline shaft portion 48*c* constitute the rotating drive unit for the cutters 33.

The rear end of the screw shaft 48 is connected via a rod 48*d* to a piston 62*a* of a hydraulic cylinder unit 62, which is in this embodiment a means for moving the shaft 48 back and force axially along the cylinder section 44. Thus, the slurried material is delivered to the injection port 44*c* and gradually accumulated in the injection port 44*c* by the rotation and forward movement of the screw shaft via a hydraulic motor 60 and hydraulic cylinder unit 62, and then the screw shaft 48 is slightly retracted by the counteraction of the slurried material accumulated in the injection port 44*c* over a distance proportional to the current accumulated amount in the port. Once a predetermined amount of the slurried material, necessary for forming a desired molded article, has been accumulated in the injection port 44*c*, the screw shaft 48 is moved forward to inject the predetermined amount of the accumulated slurried material into a metal mold 54 (FIG. 1).

According to the embodiment, the screw shaft 48 also functions as a means for measuring a current accumulated amount of the slurried material in the injection port 44*c* in order to determine whether the current accumulated amount is proper, i.e., has reached the predetermined amount. More specifically, position sensor 64 is fixed to the rod 48*d* integral with the screw shaft 48, which detects a current position of the shaft 48 to output an electrical signal indicative of the detected current position. In this illustrated example, the position sensor 64 may be a conventional reluctance-type position sensor based on the magnetoresistive effect, or an optical-type position sensor.

As will be later described in detail, the current accumulated amount of the slurried material in the injection port 44*c* can be determined from the detected current position since it corresponds to the retracted position of the screw shaft 48. Thus, when the determined accumulated amount is short of the predetermined amount necessary for forming a desired molded article, the operation of the cutters 33 is resumed to cause the material to be further accumulated until the deficient amount is covered, i.e., the predetermined amount is reached.

Now, with reference to a block diagram of FIG. 4, a description will be made about an example of a control which constantly guarantees accumulation of the predetermined amount of the slurried material in the injection port 44*c* by properly adding a deficient amount.

Figure 4:
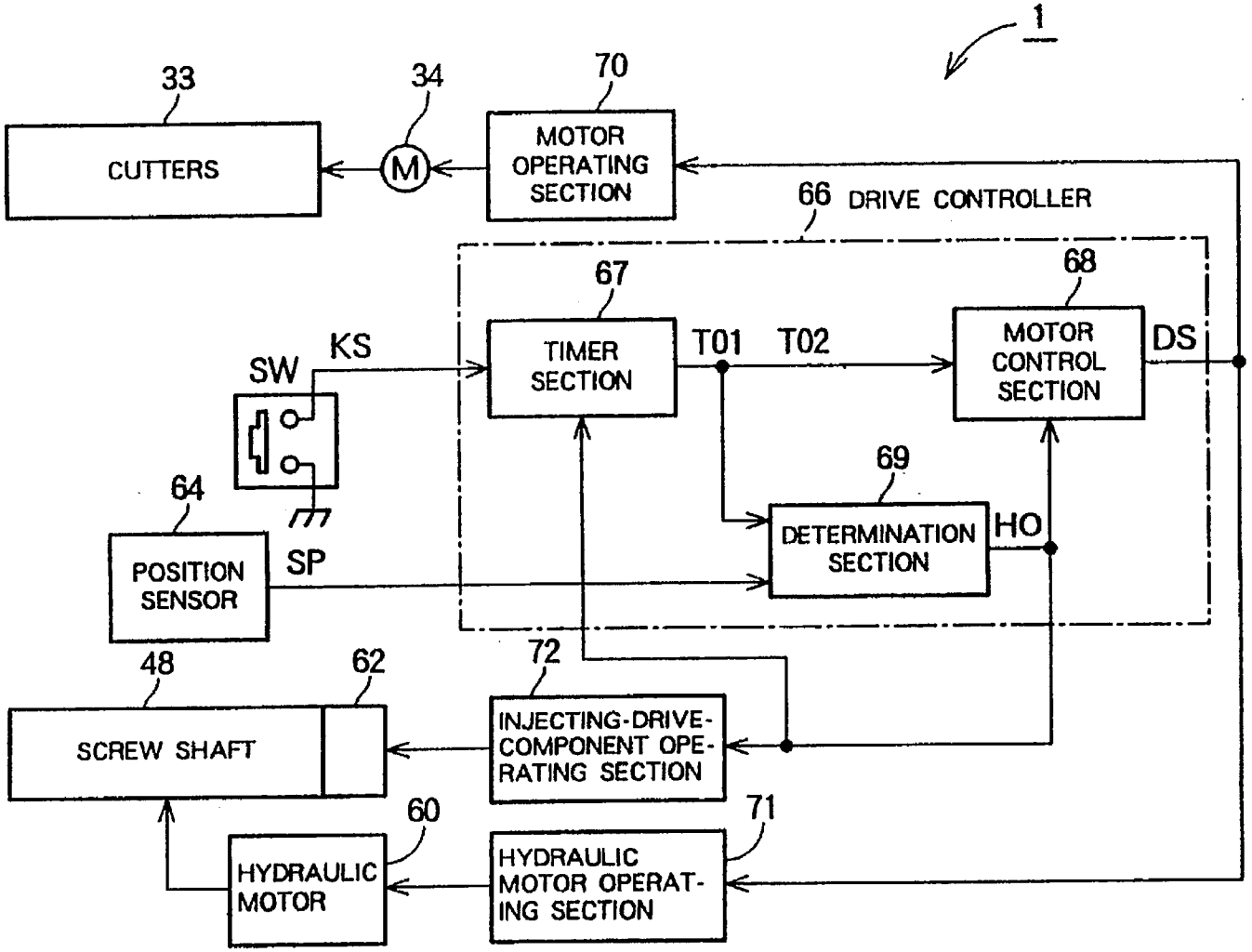
FIG. 4 is a block diagram of a control for controlling the feeding of material to be molded, measuring a current accumulated amount of the fed material and additionally supplying a lacking amount of the material.

In FIG. 4, drive controller 66 includes a timer section 67, a motor control section 68 and a determination section 69, and the controller 66 controls the injecting drive components of the apparatus which are the electric motor 34 to drive the cutters 33 and the hydraulic motor 60 and hydraulic cylinder unit 62 to drive the screw shaft 48 for the injecting and amount-measuring purposes. The timer section 67 outputs timer signals TO1 and TO2 in response to key information KS from a key switch SW, and within the duration of the timer signal TO1 or TO2, the motor control section 68 activates a motor operating section 70 as well as a hydraulic motor operating section 71.

Although the above-mentioned injecting drive components are activated by the key switch SW in this embodiment as mentioned, a separate main switch may also be provided in such a manner that the injecting drive components are activated by the main switch and the operation of the molding apparatus 1 is started and stopped for each injection of the slurried material by means of the key switch provided downstream of the main switch.

Also, on the basis of position detection signal SP output from the position sensor 64, the drive controller 66 detects a current position of the screw shaft 48 which is retracted by the counteraction of the slurried material delivered to the injection port 44*c* as previously mentioned. When it is determined that the screw shaft 48 has not retracted to a predetermined position corresponding to the predetermined accumulated amount of the slurried material, this means that the slurried material has not yet been accumulated in the injection port 44*c* to the predetermined amount, and hence the drive controller 66 further operates the motor operating section 70 and hydraulic motor operating section 71 to drive the cutters 33 and screw shaft 48 within the duration of the timer signal TO1 or TO2.

Once it is determined that the screw shaft 48 has retracted to the predetermined position, this means that the slurried material has been accumulated to the predetermined amount, and hence the drive controller 66 deactivates the motor operating section 70 and hydraulic motor operating section 71. At the same time, the drive controller 66 activates an injecting-drive-component operating section 72 so that the screw shaft 48 is moved forward by the hydraulic cylinder unit 62 so as to inject the predetermined accumulated amount of the slurried material from the port 44*c* into the mold 54.

The timer section 67 generates two kinds of timer time intervals tO1 and tO2, and the timer time tO1 is longer than the timer time tO2. During duration of the timer time tO1 or tO2, the timer section 67 outputs the timer signal TO1 or TO2, for example of high level, to the motor control section 68 and determination section 69. Upon receipt of determination signal HO (for example of high level) from the determination section 69, the timer section 67 stops counting the timer time tO1 or tO2 for resetting and sets the timer signals TO1 and TO2 to low level.

In response to the key information KS received from the switch SW, the timer section 67 first generates the timer signal TO1 and then generates the timer signal TO2 upon lapse of a predetermined short time interval tO after termination of the timer signal TO1: after termination of the first timer signal TO1, the timer section 67 repeats generation of the timer signal TO2 with the intervening time tO until the section is reset by the determination signal HO from the determination section 69.

When the timer signal TO1 or TO2 is at high level, the motor control section 68 outputs drive control signal DS, for example of high level, to activate the two operating sections 70 and 71. However, when the timer signal TO1 or TO2 is at low level, or when high-level determination signal HO has been received while the timer signal TO1 or TO2 is at high level, the motor control section 68 outputs drive control signal DS, of low level, to deactivate the two operating sections 70 and 71.

The determination section 69 comprises for example AND circuitry, and when the timer signal TO1 or TO2 and the position detection signal SP (e.g., all of these signal are of high level) are simultaneously received from the timer section 67 and position sensor 64, the section 69 outputs high-level determination signal HO to the motor control section 68 and injecting-drive-component operating section 71. In response to the high-level determination signal HO, the motor control section 68 outputs low-level drive control signal DS, so as to deactivate the motor operating sections 70 and 71 and activate the injecting-drive-component operating section 72.

Once the timer signal TO1 or TO2 and position detection signal SP are generated simultaneously, the hydraulic cylinder unit 62 is activated to initiate the injecting operation after the two motor operating sections 70 and 71 are deactivated.

Figure 5:
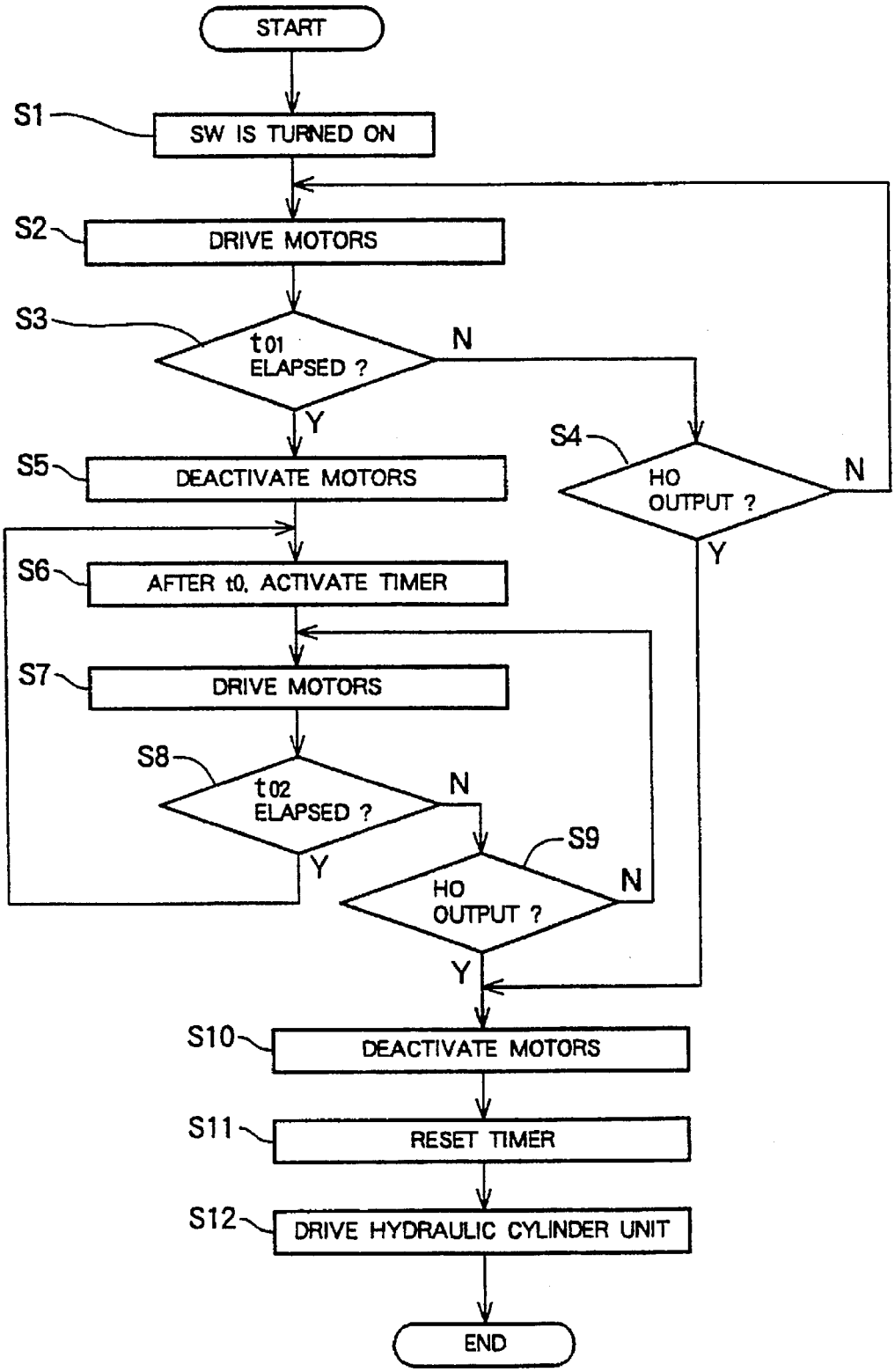
FIG. 5 is a flowchart illustrating the operational sequence of the control of FIG. 4.

An exemplary operation of of the control of FIG. 4 will be described below with reference to the flowchart of FIG. 5.

First, the key switch SW is turned on (step S1). in response to this, the electric and hydraulic motors 34 and 60 are caused to operate via the respective motor operating sections 70 and 71 (step S2), and thus the cutters 33 are driven by the motor 34 to crush the half-molten ingot W into pieces. The resultant crushed material is then introduced into the cylinder section 44 of the injecting machine 46, as mentioned earlier. Meantime, the screw shaft 48 is driven to rotate by the hydraulic motor 60, so that it kneads and slurries the crushed material and feeds the slurried material forward to the injection port 44*c*, so as to start accumulating the material in the port 44*c*.

The electric motor 34 and hydraulic motor 60 continue to be driven during the duration of the predetermined timer time tO1 under the control of the timer section 67 (step S3), as previously noted.

When the timer time tO1 has elapsed, the motors 34 and 60 are deactivated (step S5). When, however, the timer time tO1 has not elapsed, the control advances to step S4 to determine whether or not determination signal HO has been output from the determination section 69. If no determination signal HO has been output, the control repeats the operations of steps S2 and S3.

If determination signal HO has been output to indicate that the screw shaft 48 has been moved back to the predetermined position corresponding to the predetermined accumulated amount of the slurried material, the control goes to step S10 to deactivate the two motors 34 and 60. Then, the control resets the timer section 67 and activates the hydraulic cylinder unit 62 via the operating section 72 to effect injection of the slurried material accumulated to the predetermined amount.

When the time tO has elapsed after the operation of step S5, the timer section 67 is again activated (step S6) and the motors 34 and 60 are again caused to operate (step S7). Then, when the timer time tO2 has elapsed, the control repeats the operations of steps S6 and S7; before the timer time tO2 elapses, the control branches to step S9, where it is determined whether or not determination signal HO has been output from the determination section 69. If no determination signal HO has been output, the control repeats the operations of steps S7 and S8. If determination signal HO has been output, the control goes to step S10.

In the above-mentioned manner, during the duration of the timer time tO2, the control detects a current position of the screw shaft 48 on the basis of the position detection signal SP provided from the position sensor 64 to the determination section 69, and if the detected position of the screw shaft 48 is determined as coinciding with the predetermined position corresponding to the predetermined accumulated amount, the determination section 69 outputs high-level determination signal HO to deactivate the electric motor 34 and hydraulic motor 60.

After that, the timer section 67 is reset (step S11), and the hydraulic cylinder unit 62 is again activated to effect injection of the accumulated slurried material through the injection port into the mold 54 for forming of a desired metal molded article (step S12). In the event that the screw shaft 48 has not yet retracted the predetermined position, then the control reverts to step S7 to repeat the operations of steps S7, S8 and S9.

In the above-mentioned manner, the control properly controls feeding of the crushed material from the cutters 33 to the cylinder section 44, operation of the screw shaft 48 within the cylinder section 44, accumulation and subsequent measurement of the slurried material, supply of a deficient amount of the accumulated slurried material, and final injection of the predetermined accumulated amount.

Whereas all the components in the drive controller 66 has been described above as being constructed on the positive logic principle in such a manner that they are activated by a high-level signal and deactivated by a low-level signal, they may alternatively be constructed on the negative logic principle where they are activated by a low-level signal and deactivated by a high-level signal. Further, the drive control signal DS generated by the motor drive control section 68 may be simultaneously output to the two motor operating sections 70 and 71, so as to simultaneously activate or deactivate the rotary cutters 33 and screw shaft 48.

In summary, the molding apparatus having been described thus far is based on the inventors' finding that a current position of the injecting shaft 48 designed to be retracted by the counteraction from the slurried material accumulated in the injection port 44*c* corresponds to a current accumulated amount of the slurried material in the injection port 44*c*, and therefore the current accumulated amount of the slurried material can be detected by detecting the current position of the shaft 44. When the detected current accumulated amount has not reached the predetermined amount, the controller 66 further drives the cutters 33 and injecting shaft 44 for a period until the predetermined amount is reached in the port. With such control, an uniform amount of the slurried material can always be injected from the injecting machine 46 into the mold 54 and thereby it is possible to constantly form good-quality molded articles.

According to another important feature of the present invention, the heated-ingot receiving chamber 28 is constructed as follows.

Figure 6:
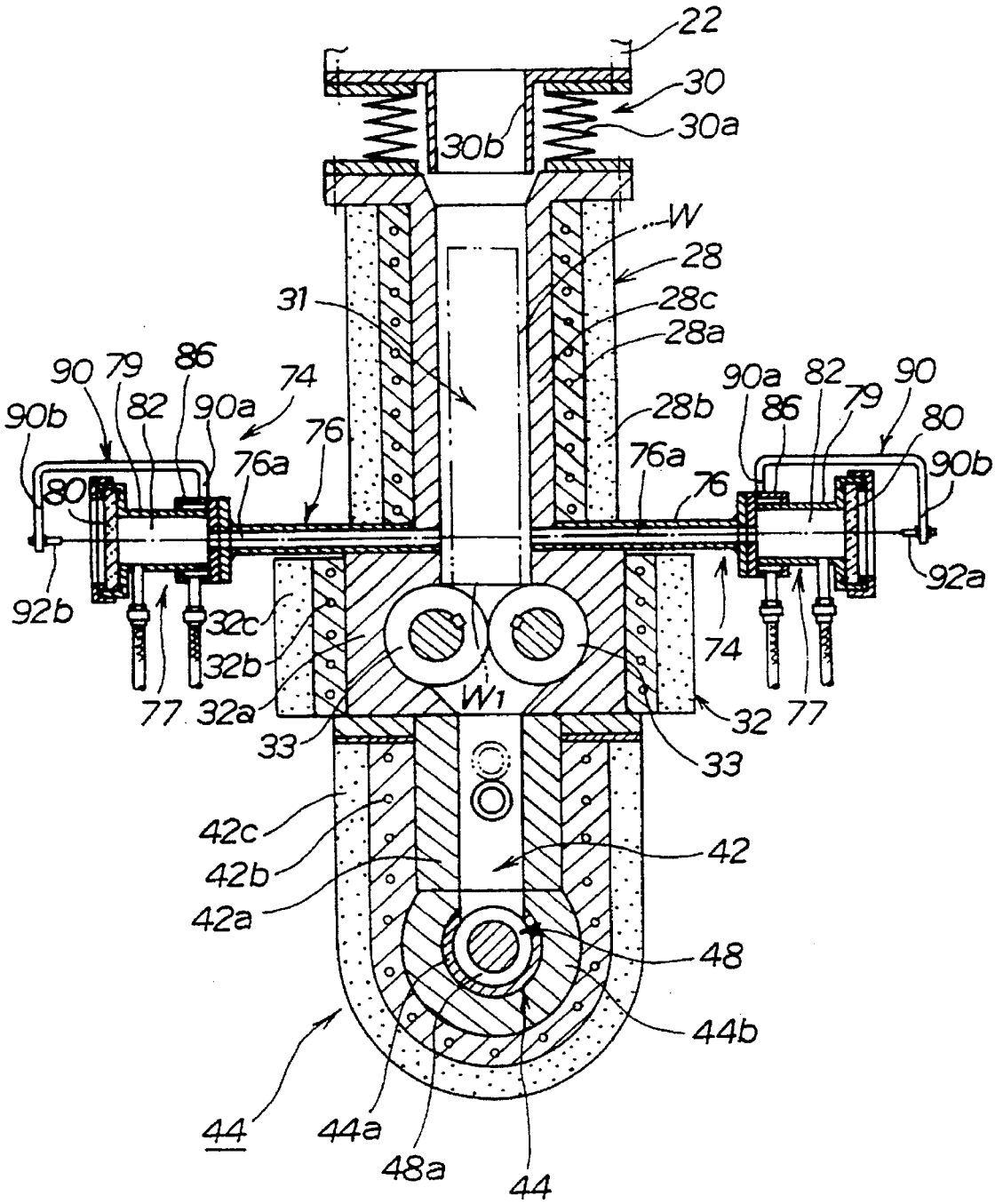
FIG. 6 is a sectional view showing passage sections mounted on a heated-ingot receiving chamber of FIG. 1.

As shown particularly in FIG. 6, the receiving chamber 28 has a pair of passage sections 74 which are disposed at the lower end of the chamber 28 (immediately above the crushing chamber 32) in diametrically opposed symmetric relation to each other, and internal hollow space of each of the passage sections 74 communicates with the interior of the receiving chamber 28. The vertical position at which the passage sections 74 are mounted correspond to the lower end portion of the ingot W received in the chamber 28.

Figure 7:
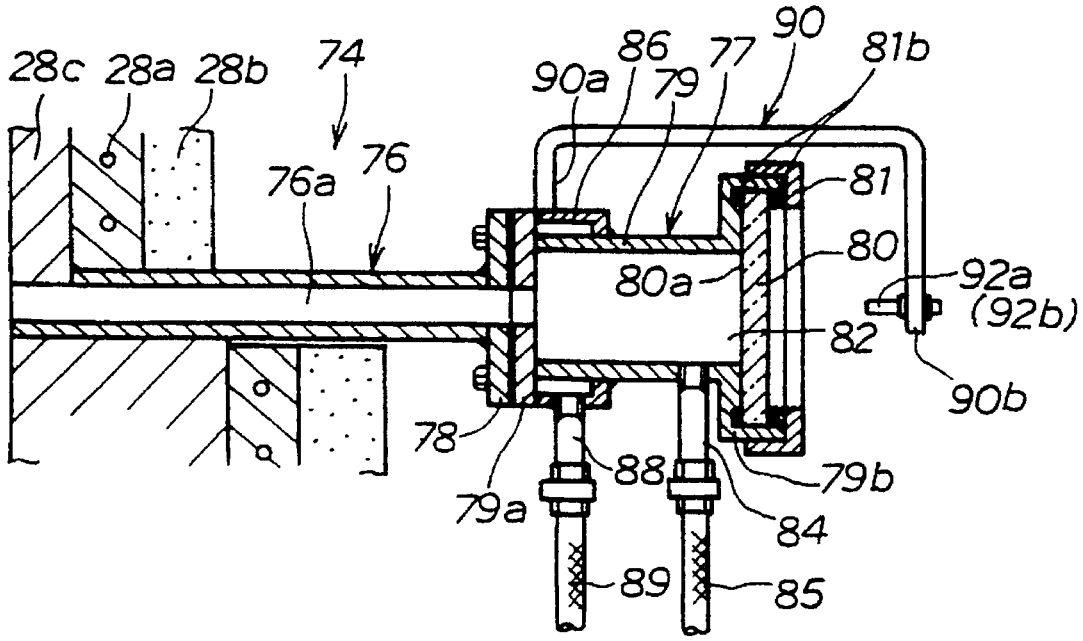
FIG. 7 is a sectional view showing a detail of one of the passage sections.

More specifically, as shown in FIG. 7, each of the passage sections 74 is comprised of a horizontal nozzle 76 and a compartment unit 77. The nozzles 76 of the two sections 74 extend horizontally from the receiving chamber 28 in opposite directions in such a manner that they project laterally from the crushing chamber 32 by a predetermined length. The respective nozzles 76 of the passage sections 74 each providing an internal hollow space 76*a* are made of pipes having the same dimension and have inner ends pierced through the insulating material 28*b*, heater 28*a* and inner cylinder 28*c*. Thus, the internal spaces 76*a* of the nozzles 76 open into the receiving chamber 28 in diametrically opposed relation to each other.

Further, the left and right nozzles 76, which are disposed in the same horizontal plane transverse of the interior of the receiving chamber 28, have outer end flanges 78, to which are bolted the left and right compartment units 77 having the same construction. Each of the compartment units 77 includes a large-diameter cylinder member 79 coaxial with the nozzle 76, and inner end flange 79*a* of the cylinder member 79 is bolted to the outer end flange 78 of the corresponding nozzle 76 with a packing member interposed therebetween. In each of the compartment units 77, light transmitting plate, such as a transparent glass plate 80, is secured to an outer end flange 79*b* of the large-diameter cylinder member 79 by a ring-shaped fastening cap 81 with intervening O-rings 81*b*. Thus, each of the compartment units 77 defines a sealed internal hollow space 82 of a predetermined capacity, which communicates with the interior of the heated-ingot receiving chamber 28 by way of the internal space 76*a* of the corresponding nozzle 76.

Further, in each of the compartment units 77, inner gas introducing nozzle 84 is connected at one end to the large-diameter cylinder member 79 and at the other end to an inert gas supply source (not shown) via a hose 85, so as to supply inert gas to the internal space 82. Water-cooling jacket 86 is fixed around the inner end portion of the large-diameter cylinder member 79. Cooling-water introducing nozzle 88 is connected at one end to the cooling jacket 86 and at the other end to a cooling water supply source (not shown) via a hose 89. The water-cooling jackets 86 operate to prevent the heat of the heated-ingot receiving chamber 28 from being conducted to the transparent glass plates 80 in the passage sections 74. In each of the passage sections 74, stay 90 generally of an inverted-U shape has an inner vertical base portion 90*a* secured at one end to the water-cooling jackets 86, a horizontal portion, and an outer vertical portion 90*b* extending downward outwardly of the corresponding compartment unit 77.

On the outer vertical portion 90*b* of the stay 90 in one of the passage sections 74, there is mounted a light emitting element 92*a* for emitting a light beam to the outer side of the compartment unit 77 in such a manner that the optical axis of the emitted light extends horizontally in the center of the internal space 76*a* of the nozzle 76 as shown by dot-dash line in FIG. 6. The light emitting element 92*a* continually emits light while the molding apparatus 1 is in operation. On the outer vertical portion 90*b* of the stay 90 in the other passage sections 74, there is mounted a light receiving element 92*b* for receiving the light beam emitted from the light emitting element 92*a*. Thus, when there is no obstacle, i.e., heated ingot W in the receiving chamber 28, the light beam emitted from the element 92*a* is directed, through the transparent glass plate 80, internal space 76*a* and internal space 82 of the one passage section 74 and interior of the receiving chamber 28, to the other passage section 74 where it passes through the internal space 76*a*, internal space 82 and transparent glass plate 80 to the light receiving element 92*b*.

Inert gas is introduced into the sealed interior spaces of the compartment units 77 via the respective inert gas introducing nozzles 84 and supplied into the heated-ingot receiving chamber 28 through the internal spaces 76*a* of the nozzles 76, and the receiving chamber 28 is maintained in an inert gas atmosphere for preventing oxidation of the ingot W received therein. Thus, the internal spaces 76*a* each function as an inert gas supply passage, and a light beam passage for optical detection of presence or absence of the ingot W in the chamber 28.

When the cutters 33 are crushing the heated ingot W received in the chamber 28 as shown in FIG. 6, the light beam emitted from the element 92*a* is blocked by the ingot W and can not reach the light receiving element 92*b*, which thus signals that the ingot W is present in the receiving chamber 28 and being crushed by the cutters 33. Therefore, in this case, a next ingot W will not be fed to the receiving chamber 28.

However, as the crushing of the ingot W progresses, the vertical length or height of the ingot W decreases, and once the upper end of the ingot W becomes lower than the lower end of the internal spaces 76*a*, the emitted light from the light emitting element 92*a* can reach the light receiving element 92*b*, which thus supplies a controller (not shown) with a signal indicating that no ingot W is present in the receiving chamber and a next ingot W may be fed to the receiving chamber 28. In response to this signal, the stopper 15 is pivoted downwardly to release the next ingot W waiting in the heating chamber 4, and the lower shutter 20 is moved to the opened position to allow the released ingot W to be fed through the guiding chamber 22, etc. to the receiving chamber 28.

As described above, the molding apparatus 1 uses the light emitting and receiving elements 92*a* and 92*b* to continually monitor presence or absence of an ingot W in the receiving chamber 28, and thereby permits a succeeding ingot W to be automatically fed to the chamber 28 and hence the cutters 33 when a preceding ingot W has been crushed almost completely.

Because the receiving chamber 28 is normally maintained at a predetermined temperature by the heater 28*a* to allow the ingot W to be fed to the cutters 33 in the heated condition, the heat of the receiving chamber 28 is undesirably conducted via the nozzles 76, etc. to the compartment units 77, where the heat is conducted through the stays 90 to the light emitting and receiving elements 90*a* and 90*b* which are electronic devices having low heat tolerance. However, by the provision of the water-cooling jackets 86 connected with the stays 90, the molding apparatus 1 according to the embodiment can effectively prevent the heat from being conducted to the light emitting and receiving elements 92*a* and 92*b* and even keep cool the elements 92*a* and 92*b*.

Consequently, even though the relatively hot receiving chamber 28 is connected with the light emitting and receiving elements 92*a* and 92*b* by way of the nozzles 76 functioning also as gas passages, it is possible to avoid adverse thermal effects on the elements 92*a* and 92*b*, and hence permit smooth and reliable operation of these elements 92*a* and 92*b*.

Figure 8:
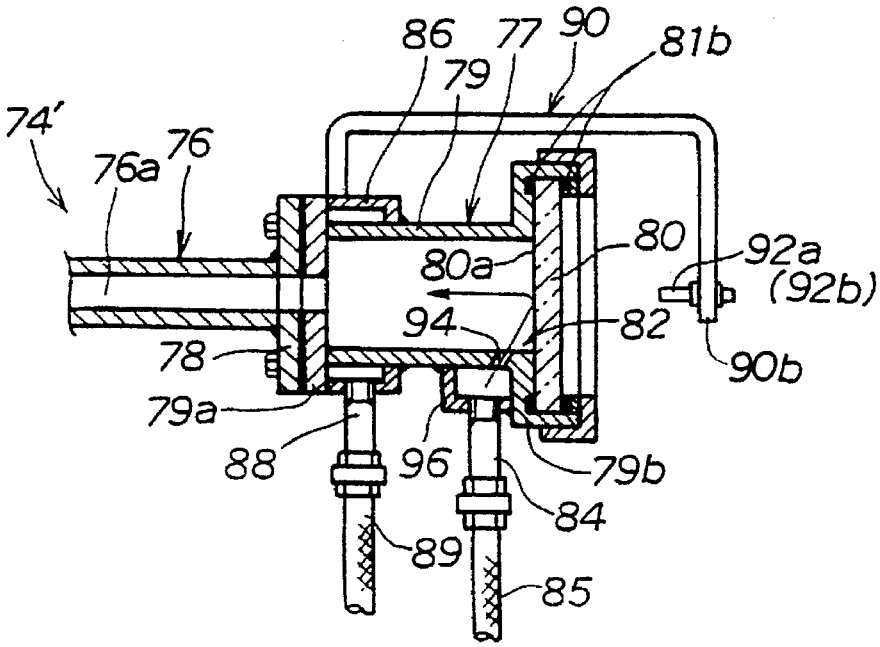
FIG. 8 is a sectional view showing a modification of the passage section.
Figure 9:
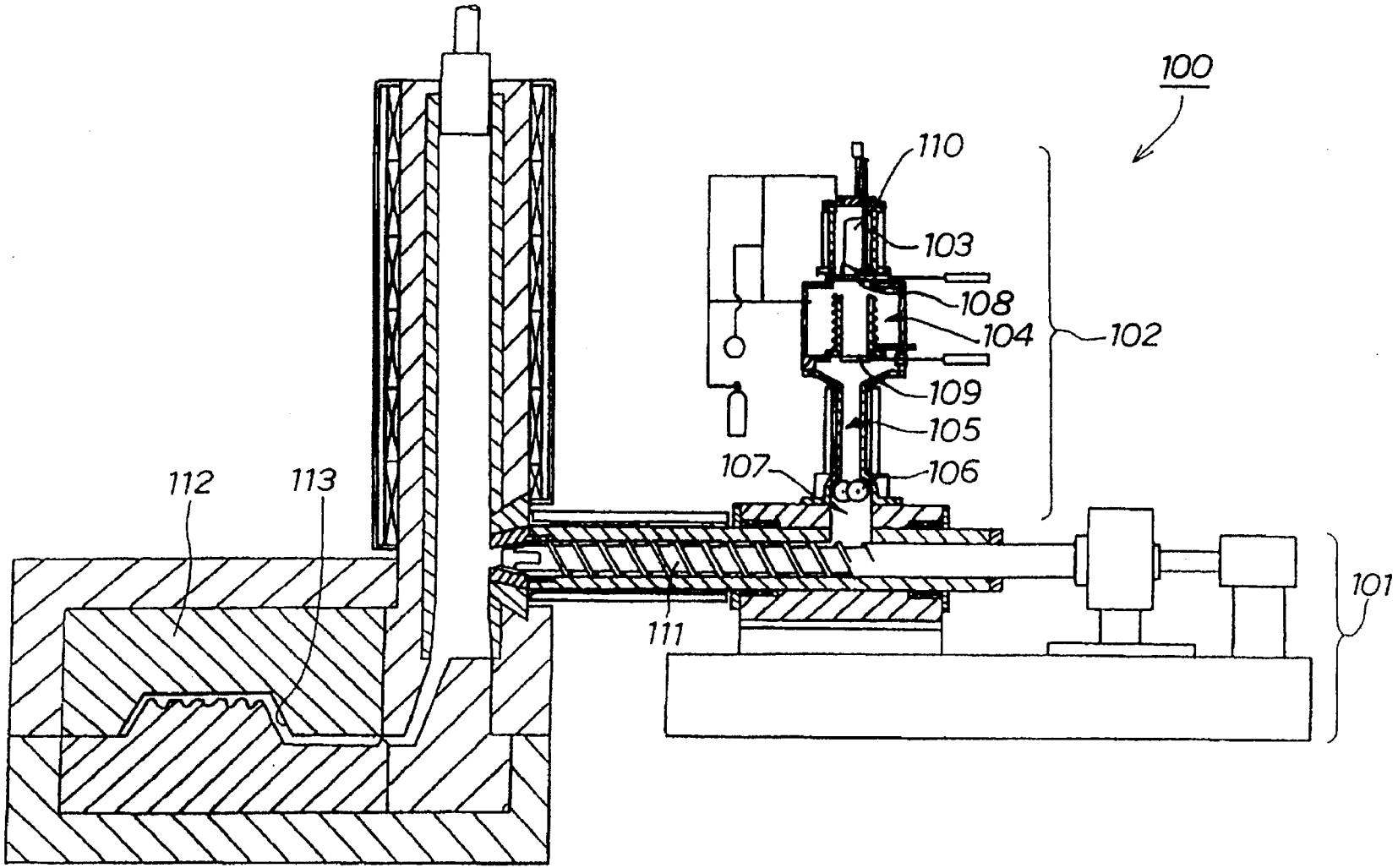
FIG. 9 PRIOR ART
FIG. 9 is a vertical sectional view schematically showing a prior art injection molding apparatus for manufacturing a metal molded article.

FIG. 8 shows a modification of the passage sections, where the same reference numerals as in FIGS. 6 and 7 denote the same elements as in the figures. Only one of the passage sections 74' is shown in FIG. 8 for simplicity because the two sections 74' are almost identical in construction as in the case of the first-described counterparts 74.

This modified passage section 74' has been directed to solving problems caused by ingot particles resulting from the crushing of ingots W. Namely, there is a possibility that such ingot particles will flow through the receiving chamber 28 into the internal spaces 76*a* of the nozzles 76 and even stick to the inner surface of the transparent glass plates 80 facing the respective interior spaces 82, thereby reducing the transparency of the glass plates 80.

To avoid such reduction in the transparency, in each of the modified passage sections 74', gas entry port 94 is provided, at the tip of the inert gas introducing nozzle 84, to obliquely extend so as to face the inner surface 80*a* of the glass plate 80. The inert gas supplied via the nozzle 84 is obliquely directed or blown through the guide 94 onto the glass plate inner surface 80*a*. Thus, the glass plate inner surface 80*a* is cleaned by the inert gas and can constantly keep sufficient transparency. In the illustrated example, the entry port 94 is disposed adjacent the inner surface 80*a*, and the nozzle 84 is connected with a jacket 96 surrounding the entry port 94.

In summary, in the molding apparatus shown in FIGS. 6 to 8, the passage sections 74 are designed to function as light beam passages for the photo sensor elements 92*a* and 92*b* for detecting whether there is any heated material in the receiving chamber 28, and also as passages for supplying inert gas into the receiving chamber 28. Namely, the passage sections 74 can be used in common for optically detecting an heated material in the receiving chamber 28 and supplying inert gas into the receiving chamber 28, and this can greatly simplify the arrangements required for the optical detection of presence or absence of the heated material in the receiving chamber 28 and inert gas supply to the receiving chamber 28.

What is claimed is:

1. An injection molding apparatus, for manufacturing a metal molded article, comprising:

a heating chamber for heating a material to be molded;

crusher means for crushing the material heated in said heating chamber;

an injecting machine including an injecting chamber to receive the ingot crushed by said crusher means, and an injecting shaft rotatably provided within said injecting chamber and axially movable along said injecting chamber toward and away from a mold, said shaft slurrying the crushed material and feeding the slurried material to an injection port formed between fore end portions of said shaft and injecting chamber adjacent the mold so that the slurried material is gradually accumulated in said injection port, said shaft being slightly retracted away from the mold, by counteraction from the slurried material accumulated in said port, over a distance proportional to a current accumulated amount of the slurried material in said port, wherein only when the slurried material is accumulated in said port to a predetermined amount necessary for forming a desired metal molded article, said shaft is driven to move toward the mold to inject said predetermined amount of the slurried material from said port into the mold;

determination means for detecting a current position of said shaft to thereby detect a current accumulated amount of the slurried material in said port, and for determining whether the detected current accumulated amount of the slurried material has reached said predetermined amount; and control means for, when said determination means determines that the detected current accumulated amount has not reached said predetermined amount, further driving said crusher means and shaft until an amount of the slurried material short of said predetermined amount is additionally supplied to said port.

2. An injection molding apparatus, for manufacturing a metal molded article, comprising:

a heating chamber for heating a material to be molded;

a receiving chamber for receiving the material heated in said heating chamber, said receiving chamber being maintained at a temperature to retain heat of the heated material and also in an inert gas atmosphere to prevent oxidation of the heated material received therein;

crusher means for crushing the heated material received in said receiving chamber;

an injecting machine including an injecting chamber to receive the ingot crushed by said crusher means, and an injecting shaft rotatably provided within said injecting chamber and axially movable along said injecting chamber to slurry the crushed material and inject the slurried material into a mold;

a pair of passage sections provided at predetermined positions on an outer surface of said receiving chamber in opposed relation to each other, said passage sections having internal hollow spaces communicating with an interior of said receiving chamber generally in a same plane transverse of the interior of said receiving chamber;

a photo sensor for detecting whether there is any heated material in said receiving chamber, said sensor including a light emitting element mounted on one of said passage sections and and a light receiving element mounted on the other of said passage sections so that a light beam emitted by said emitting element on said one passage section is allowed to pass through the interior of said receiving chamber to said receiving element on said other passage section along said hollow spaces when there is no heated material in said receiving chamber; and inert gas supply means including pipes connected to said passage sections for introducing inert gas into said receiving chamber via said internal hollow spaces of said passage sections, wherein said passage sections function as passages for both the light beam and inert gas.

3. An injection molding apparatus as defined in claim 2 wherein said light emitting and receiving elements are mounted at positions corresponding lower end of the material received in said receiving chamber.

4. An injection molding apparatus as defined in claim 2 wherein said hollow space of each said passage section is covered at an outer end thereof with a transparent glass plate and said light emitting and receiving elements are disposed outwardly of said glass plates, and each said passage section has an inert gas entry port opening toward said glass plate so that the inert gas supplied by said gas supply means is blown via said entry port onto said glass plate.

5. An injection molding apparatus as defined in claim 2 wherein each of said light emitting and receiving elements is mounted on a stay secured a corresponding one of said passage sections, and each said passage section includes a water-cooling jacket connected to said stay for preventing heat of said receiving chamber from being conducted via said stay to the corresponding one of said light emitting and receiving elements.

* * * * *